United States Patent [19]

Randolph

[11] 4,130,935

[45] Dec. 26, 1978

[54] QUILTING BUTTON PART HOLDER

[75] Inventor: Arthur J. Randolph, Santa Rosa, Calif.

[73] Assignee: Tuftamatic, Inc., Santa Rosa, Calif.

[21] Appl. No.: 841,305

[22] Filed: Oct. 12, 1977

Related U.S. Application Data

[63] Continuation-in-part of Ser. No. 748,132, Dec. 6, 1976, Pat. No. 4,059,889.

[51] Int. Cl.[2] ..... B23Q 7/10

[52] U.S. Cl. ..... 29/706; 29/789; 29/823; 112/119

[58] Field of Search ..... 29/706, 717, 718, 771, 29/789, 790, 798, 809, 823; 227/58–60, 116; 112/117, 118, 119

[56] References Cited

U.S. PATENT DOCUMENTS

| | | | |
|---|---|---|---|
| 2,878,556 | 3/1959 | Heidergitt et al. | 29/718 |
| 3,577,624 | 5/1971 | Bentshneider | 29/718 |
| 3,588,995 | 6/1971 | Schoepe et al. | 29/788 X |
| 3,995,359 | 12/1976 | Randolph | 29/809 |
| 4,059,889 | 11/1977 | Randolph | 29/706 |

*Primary Examiner*—Leon Gilden

*Attorney, Agent, or Firm*—Edward B. Gregg; Alvin E. Hendricson

[57] ABSTRACT

In a quilting machine adapted to drive two mating parts of a quilting button through a work piece and engage these parts, an improved button part holder has spring-loaded pivotally-mounted retainers for holding a male button part and evenly releasing same as the part is very rapidly driven from the holder by the machine.

4 Claims, 5 Drawing Figures

21
22
23
31
32
33
34
36
37
38
39
121
2
2

QUILTING BUTTON PART HOLDER

This is a continuation-in-part of copending patent application Ser. No. 748,132, filed in the United States Patent Office on Dec. 6, 1976 now U.S. Pat. No. 4,059,889, for an Improved Quilting Machine.

BACKGROUND

There has been developed a two-part plastic quilting button as set forth in U.S. Pat. No. 3,701,174, which is adapted to be easily and very rapidly inserted in a work piece and locked together. There have also been developed machines for inserting the foregoing quilting button and one of the major aims thereof is high speed operation. Such machines, as shown in U.S. Pat. No. 3,995,359, and U.S. Patent Application Ser. No. 748,132, are capable of inserting and locking a quilting button every second or less and thus it will be appreciated that button drive means and feed means operate very rapidly. This high speed of operation imposes stringent requirements upon moving parts, particularly in view of the very considerable force applied to drive quilting buttons through chair pads, lounge pads and the like.

It has been found that the feed, placement, and release of the male button part can be improved to provide even greater insurance against malfunction of the quilting machine. In particular, the present invention materially decreases the possibility of misalignment of a male button part as it is driven toward and into a female button part, so as to prevent possible jamming of a button part in the machine.

SUMMARY

The present invention relates to a device for receiving successive male button parts, positioning each individual part in position to be driven, and releasing the part as it is driven by a quilting machine. The overall machine may be comprised, for example, as shown in the above-noted patents and generally includes feed means, such as a slotted track along which male button parts move with a top flange thereof fitting in tracks and the body or shank thereof depending between the tracks. The button part holder has an upper surface across which the button part flange slides while the shank moves through a side slot in the holder. The button part is moved into a central vertical aperture in the holder and supported therein by release means so that drive means may strike the button flange and drive the part downward through the holder into a female button part previously driven through a workpiece, such as a chair pad or the like. Pivotally mounted jaws are provided beneath the holder to engage the pad and assist in directing the male button part.

The button part holder of the present invention includes a plate having a central drive aperture therethrough having a cross section conforming to the button part flange in size and configuration, so that drive means may push the part therethrough. The plate has a side slot therethrough for passage of a button part shank as the flange of the part is slid over the top of the plate into the central drive aperture. Provision is herein made for resiliently retaining the button part in the plate opening by a pair of retainers pivotally mounted in slots in the plate extending laterally from opposite sides of the drive opening. The retainers are engaged by resilient means urging the retainers into a normal position aligned with the top surface of the plate and extending into the drive opening in spaced relation to each other for supporting a button part by engaging the underside of the flange thereof. As the drive means moves through the holder, it strikes the top of the flange of the button part and forces the button part downwardly through the plate drive opening as the retainers are resiliently pivoted downwardly by the driving force on the button part.

The two like retainers of the present invention are mounted snuggly within slots in the holder plate, so as to be capable of pivoting motion only and they each extend the same distance into the drive opening so that they both move together equally as the drive means engages a button part supported by the retainers. Consequently, the button part is moved axially downward by the drive means without danger of deviation in the path of the part, so that malfunction in male button part drive is substantially precluded.

DESCRIPTION OF FIGURES

The present invention is illustrated as to a single preferred embodiment in the accompanying drawings wherein.

DESCRIPTION OF PREFERRED EMBODIMENT

Figure 1:
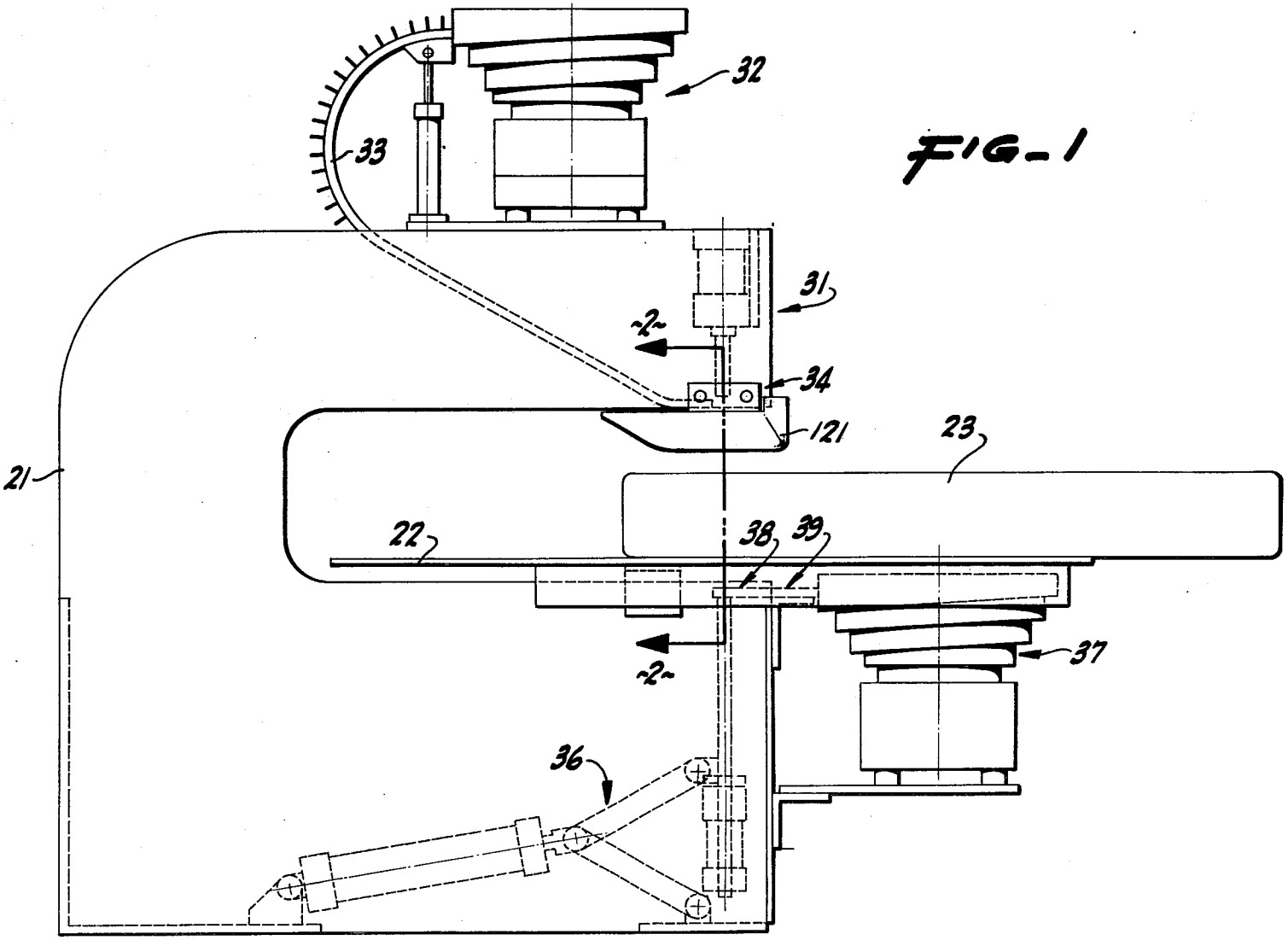
FIG. 1 is a side elevational view of a quilting machine incorporating the present invention.
Figure 2:
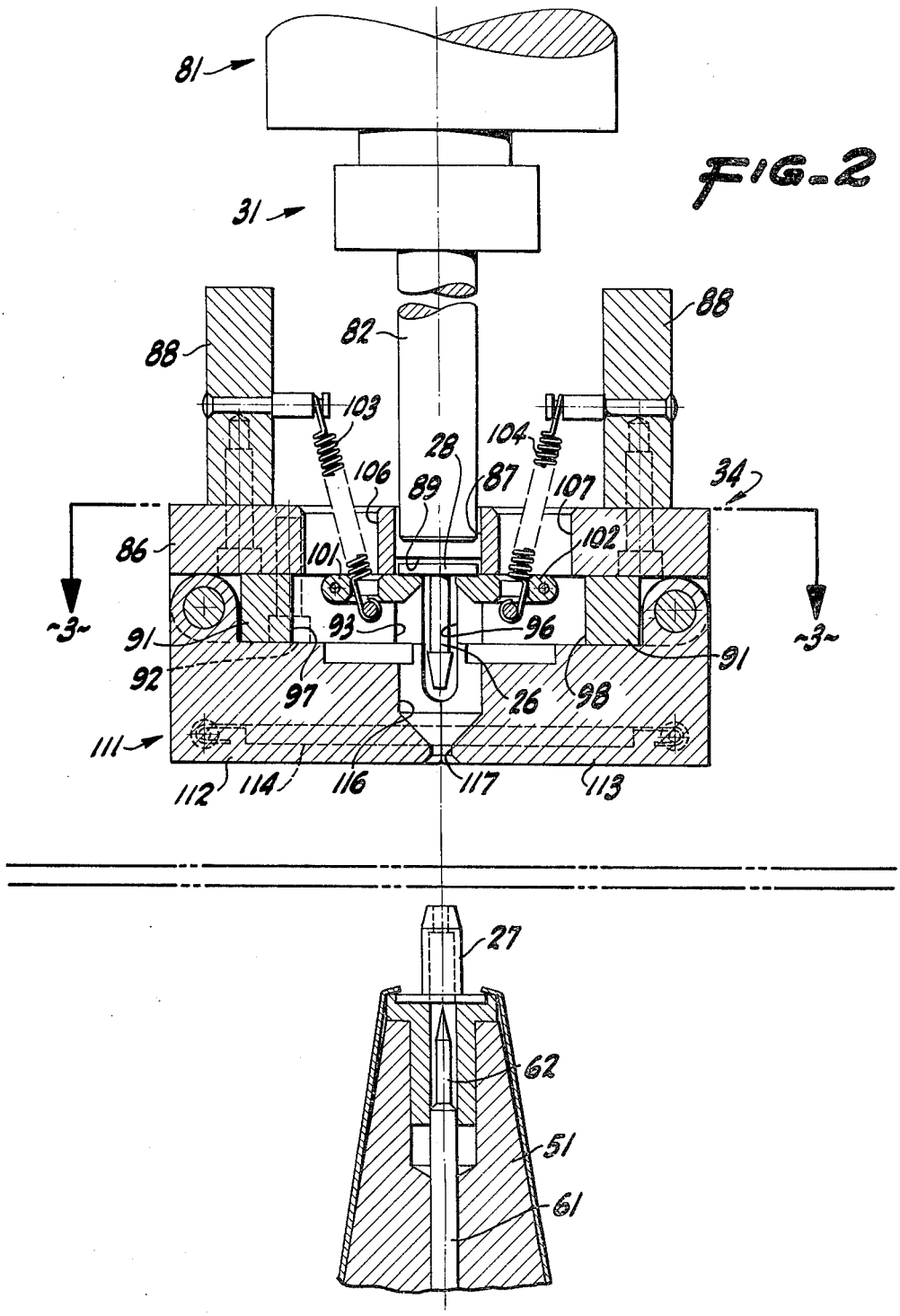
FIG. 2 is a partial vertical sectional view taken in the plane 2—2 of FIG. 1.
Figure 5:
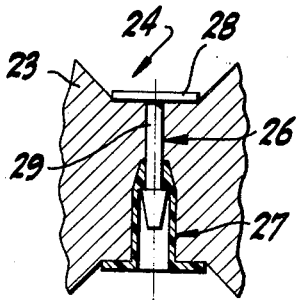
FIG. 5 is a central vertical sectional view of a quilting button as is employed in the present invention extending through a workpiece and having the parts thereof engaging.

The present invention forms a part of and comprises an improvement in a quilting machine, such as the one described and claimed in U.S. Patent Application Ser. No. 748,132, and reference is made thereto for a detailed description of such a machine. The quilting machine hereof is generally illustrated in FIGS. 1 and 2 of the drawings and referring thereto, it is briefly noted that the machine includes a frame 21 which may be formed of a pair of spaced side plates suitably secured together and defining a central lateral opening wherein is mounted an apertured work table 22 upon which a pad or the like 23 may be movably disposed for the insertion of quilting buttons therethrough. The quilting button employed in the present invention is set forth in U.S. Pat. No. 3,701,174 and this quilting button 24, as illustrated in FIG. 5, generally comprises a male button part 26 and female button part 27 with the male button part having a top flange 28 and depending shank 29 adapted to be driven into the female button part for locking the parts together.

The quilting machine includes an upper drive means 31 adapted to receive male button parts from an upper feed mechanism 32 mounted atop the frame and having a track 33 extending therefrom to a male button part holder 34 disposed immediately beneath the upper drive mechanism 31. Beneath the work table 22, there is provided lower drive means 36 with lower feed means 37 feeding female button parts into a female button holder 38 along a track 39.

The quilting machine of the present invention operates to automatically feed male and female button parts into the holders 34 and 38 therefor, and to drive a female button part through an opening in the work table 22 through the pad 23 at a desired location thereof. A male button part is then driven by the upper drive means 31 downwardly into the female button part, so that the parts of a quilting button 24 are locked together in quilted engagement through the pad 23. No attempt is made herein to describe all of the elements of the quilting machine inasmuch as these are set forth in detail in the above-identified patent application, however, it is noted that a female button part 27 is adapted to be disposed atop a slide plate 51 which is driven upwardly by the lower drive means, and a lower drive cylinder piston rod 61 has a needle 62 atop same which is adapted to be driven through the female button part 27 to assist in driving this button part through a workpiece. The needle 62 is then retracted as the male button part 26 is driven into the female button part.

Figure 3:
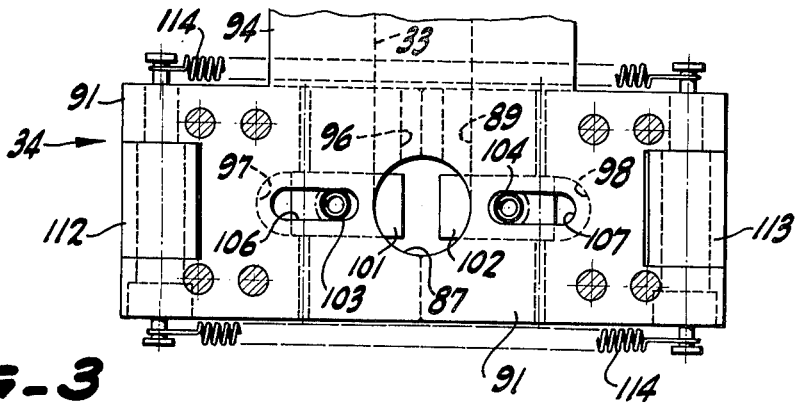
FIG. 3 is a transverse sectional view across the top of the button part holder of the present invention and taken in the plane 3—3 of FIG. 2.

Referring now particularly to FIGS. 2 and 3, there will be seen to be shown the male button part holder 34 of the present invention in some detail. The upper drive mechanism 31 includes a pneumatic or hydraulic upper drive cylinder 81 mounted on the frame 21 and having a piston rod 82 extending downwardly therefrom in axial alignment with the lower drive cylinder piston rod 61. The upper drive piston rod 82 is adapted to be driven downwardly through the male button holder 34 for engaging a male button part 26 disposed therein and forcing this button part downwardly into engagement with a female button part. The male button part holder 34 includes a transverse plate 85 having a central aperture 87 therethrough in alignment with the piston rod 82 and a pair of upright plates 88 are secured as by bolts, atop the transverse plate 86 on opposite sides of the piston rod 82 for mounting of the holder in the frame. The aperture 87 is shaped to match the configuration of the male button part flange. A mounting or holder plate 91 is secured contiguously beneath the transverse plate 86 by bolts 92 and is provided with a central circular aperture 93 therethrough in alignment with the aperture 87 in the transverse plate 86. A rear extension 94 is provided on the transverse plate 86 for mounting of the upper track mechanism 33 and a lateral slot 89 is provided on the under surface of the plate 86 for movement of a male button part flange therethrough. A further slot 96 is provided through the plate 91 from the back side into communication with the central aperture and in alignment with the track 33 for movement of a button part shank therethrough.

The plate 91 is furthermore provided with a pair of aligned slots 97 and 98 extending in opposite directions from the central aperture 93 therethrough for the mounting of a pair of retainers 101 and 102. The retainers 101 and 102 are alike, although oppositely disposed, and are pivotally mounted in the slots 97 and 98 respectively, with the adjacent or inner edges thereof normally disposed within the central aperture 93 of the plate 91 in spaced apart relation, as indicated in FIG. 3. The retainers 101 and 102 fit the slots 97 and 98 so as to slidably engage the sides thereof as the retainers are pivoted and these retainers are maintained in normal horizontal position engaging the under side of the plate 86 by means of like springs 103 and 104, respectively. These springs 103 and 104 are attached to the retainers and extend upwardly through openings 106 and 107 in the plate 86 for attachment to the parallel plates 88, as by fittings thereon. The springs apply the same upward force to each of the retainers.

The retainers 101 and 102 are preferably formed as rectangular plates fitting within slots 103 and 104, respectively, with the facing surfaces of the retainers being bevelled on the under side thereof and each preferably provided with a small curved bevelled indentation on the upper surface of the facing edges, as illustrated in FIGS. 2 and 3. The separation of the adjacent edges of the retainers 101 and 102 is slightly greater than the diameter of the shank 29 of a male button part 26. Thus a male button part fed into the holder along the track 33 moves therein with the shank 29 extending through the slot 96 of the plate 91 and the flange 28 of the button part sliding onto the upper surface of the retainers 101 and 102 within the aperture 87 in the transverse plate 86. As noted above, the retainers 101 and 102 are adapted to be pivoted against the force of the springs 103 and 104, respectively, as a male button part is driven from the holder.

In addition to the above-described elements of the male button holder 34, there are also provided deflecting means 111 comprised as a pair of pivotally mounted jaws 112 and 113. These jaws may be mounted by the provision of an upstanding lug upon each jaw which is pinned between end extensions of the mounting plate 91. The jaws of the deflecting means 111 are normally maintained in engagement with the under side of the plate 91, as illustrated in FIG. 3, by means of a pair of springs 114 mounted between the jaws at the front and back thereof, as by pins extending therefrom. The jaws together provide a central circular opening 116 extending vertically therethrough in alignment with the central aperture 93 in the plate 91 and have a tapered restriction adjacent the lower end of this opening. In addition, the jaws 106 and 107 together define a rear lateral opening or slot comprising a lower extension of the feed slot 96 in the plate 91, in order to accommodate movement of the male button part into the holder. The central opening 116 in the deflecting means 111 tapers conically inward to a restricted opening 117 from both ends of the latter, in order to assist in maintaining axial movement of the male button part during driving thereof and improved engagement of the deflecting means with a workpiece. There are also provided depressions in the upper surface of the jaw 106 and 107 in order to accommodate the pivotal movement of the retainers 101 and 102 without striking the jaws.

Considering now the operation of the present invention, it is first noted that the overall operation of the quilting machine hereof is substantially the same as the operation of the machine as described in the above-identified patent application, wherein a female button part 27 is first driven upwardly through the workpiece 26 against an apertured guard 121. Consequently, the description of operation hereof is primarily limited to the operation of the male button part holder which comprises the improvement of the present invention. Male button parts 26 move along with track 33 into the male button part holder wherein the male button part moves laterally into the holder with the flange 28 moving onto the top of the retainers 101 and 102 and the shank moving laterally through the slot 96 until the button part is disposed within the aligned apertures 87 and 93 of the plates 86 and 91. In accordance with operation of the machine, the male button part 26 is driven downwardly after the female button part is driven through the workpiece.

Driving of the male button part is accomplished by actuating the cylinder 81 to force the piston rod 82 thereof axially downward at a substantial rate whereby the piston rod strikes the upper surface of the flange 28 of the male button part with a considerable force. As noted above, the male button part is located and maintained within the holder in the position illustrated in FIG. 2 by the retainers 101 and 102 disposed beneath the flange 28 of the button part. These retainers are normally maintained in the position illustrated in FIG. 2 by like springs 103 and 104 urging the retainers upward into contact with the upper surface of the plate 86. As the piston rod 82 descends, it strikes the male button part to force this button part downwardly and this pivots the retainers 102 and 103 downwardly against the force of the springs 103 and 104, respectively, so that the button part is smoothly and evenly released from the holder and moves downwardly, so that the lower portion of the shank 29 enters the restricted opening 117 in the deflector 111. The piston rod moves downwardly between the retainers 102 and 103, as shown in FIG. 4, and as the male button part is continuously driven downward, the flange 28 thereof will engage the tapered lower portion of the opening 116 in the deflector, so as to force the jaws 113 and 114 apart, again as illustrated in FIG. 4.

Figure 4:
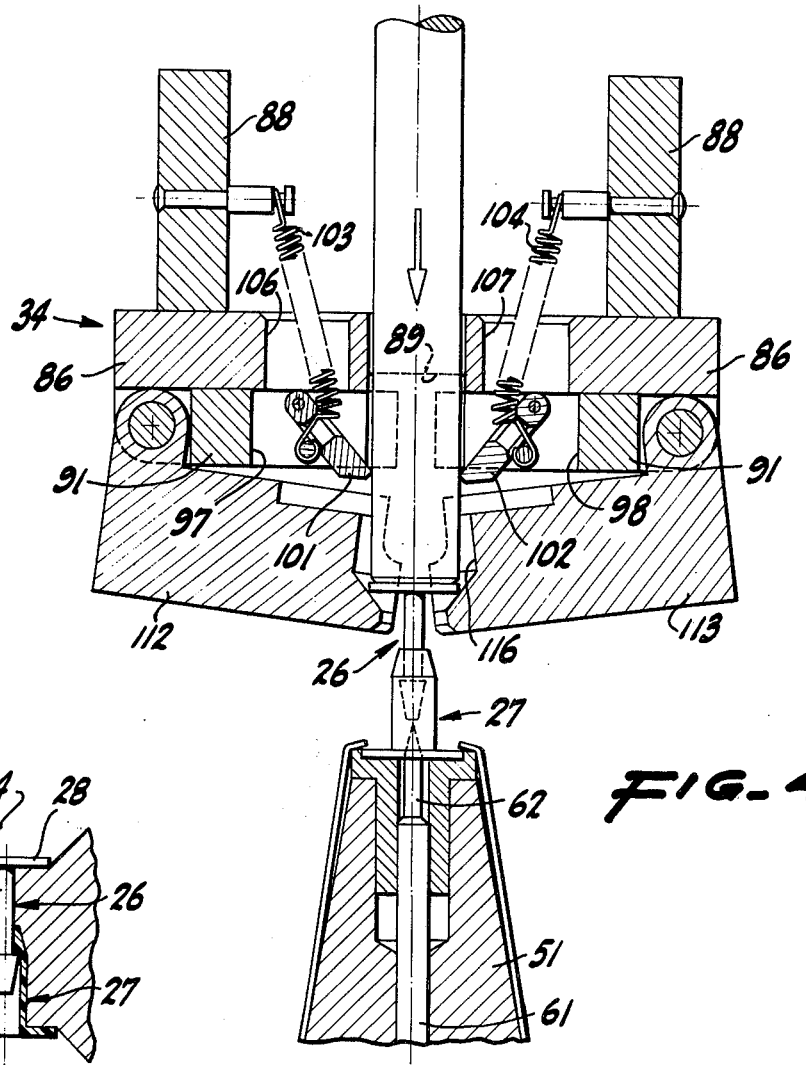
FIG. 4 is a partial central vertical sectional view taken in the plane 2—2 of FIG. 1 and showing the mechanism in operated position with a male button part driven into a female button part.

As the male button part 26 is driven downwardly, the needle 62 in the female button part is retracted, as shown in FIG. 4, so that the shank of the male button part is driven into the female button part for locking these button parts together. The action of the retainers 101 and 102 of the present invention serves to positively retain a male button part in position within the holder, prior to driving the button part and smoothly and evenly release the button part as the piston rod 82 descends. Because of the force involved in driving the button parts together and the speed of operation of the present invention, it is quite important that the male button part be evenly released when it is struck by the piston rod 82 of the drive means. Any possible binding or the like may cause the male button part to be tilted by the piston rod striking the button part and this could cause the male button part to become jammed in the holder. Again noting the forces involved, it is quite possible for a jammed male button part to be smashed in the holder and thus to render the machine inoperative until the button part is removed. It is also possible for the button part to be slightly misaligned during driving if the part is not properly released, and thus to strike the female button part off center. This latter possibility would produce a faulty quilting operation.

It is noted that the deflecting means, including the pivotally mounted jaw 113 and 114 serve to align the male button part in the lower portion of travel thereof. However, here again, the speed of operation of a quilting machine of this type increases the possibilities of difficulty from minor misalignments or the like, so that very highly reliable arrangements of elements are necessary in order to preclude possible difficulties or jamming of the machine.

The present invention does provide a substantial improvement in the holding and release of male button parts in the quilting machine of the type prescribed herein. By pivoting the retainers 101 and 102 in the slots 97 and 98, it has been found that continuous high speed operation of the machine does not cause or produce any binding or misalignment of the male button part which could cause jammings of the machine or faulty engagement of the button parts.

Although the present invention has been described above with respect to a single preferred embodiment thereof, it will be appreciated that variations and modifications are possible within the spirit and scope of the present invention and thus it is not intended to limit the invention to the precise terms of description or details of illustration.

What is claimed is:

1. A button part holder for a quilting machine adapted to drive a flanged male button part downwardly by drive means into a female button part comprising a holder plate having a circular opening therethrough with a pair of slots extending through said plate and disposed in alignment on opposite lateral sides of said opening and a feed slot extending through said plate from a side thereof to said opening and disposed perpendicularly to said pair of slots, a pair of retainers pivotally mounted one in each of said pair of slots and normally extending into said central plate opening with a space between adjacent edges therein, and resilient means connected to said retainers and urging same into normal unpivoted position in alignment with an upper surface of said plate whereby said plate is adapted to receive a flanged button part moved onto the plate with a depending portion of the button part moved through said feed slot to support the button part by the flange thereof resting upon said retainers within said central plate opening and allowing said retainers to pivot downwardly in the slots wherein they are mounted as a button part is driven downwardly through the central opening in said plate and pivoting said retainers back into normal position upon retraction of said drive means.

2. The button part holder of claim 1 further defined by said retainers fitting into the slots of said pair of slots in sliding engagement with the sides of said slots for preventing any motion of said retainers except pivotal movement.

3. The button part holder of claim 1 further defined by a transvere plate disposed atop said holder plate in contiguous relation thereto and having a central opening therethrough aligned with the opening through said holder plate for movement of drive means through said openings, and said retainers being urged downwardly against the underside of said transverse plate by said resilient means.

4. The button part holder of claim 3 further defined by said transverse plate having a pair of openings therethrough above said pair of slots in said holder plate and said resilient means comprising a pair of like springs connected one to each retainer and extending upward through said pair of openings in said transverse plate for engagement above said transverse plate to normally pivot said retainers upward into horizontal alignment with each other.

* * * * *